US005624248A

United States Patent [19]

Kassen et al.

[11] Patent Number: 5,624,248

[45] Date of Patent: Apr. 29, 1997

[54] GEROTOR MOTOR AND IMPROVED BALANCING PLATE SEAL THEREFOR

[75] Inventors: Gary R. Kassen, Chanhassen; Marvin L. Bernstrom, Eden Prairie, both of Minn.

[73] Assignee: Eaton Corporation, Cleveland, Ohio

[21] Appl. No.: 604,589

[22] Filed: Feb. 21, 1996

[51] Int. Cl.[6] ..... F01C 1/10; F01C 19/06; F03C 2/08

[52] U.S. Cl. ..... 418/61.3; 418/132; 418/133; 418/149; 418/187

[58] Field of Search ..... 418/61.3, 132, 418/133, 149, 186, 187

[56] References Cited

U.S. PATENT DOCUMENTS

| | | | |
|---|---|---|---|
| 3,695,791 | 10/1972 | Brundage | 418/131 |
| 3,696,710 | 10/1972 | Ortelli | 91/487 |
| 3,869,228 | 3/1975 | Swedberg | 418/132 |
| 4,717,320 | 1/1988 | White | 418/61.3 |
| 4,917,585 | 4/1990 | Niemiec et al. | 418/61.3 |
| 4,934,911 | 6/1990 | Schulz | 418/61.3 |
| 4,976,594 | 12/1990 | Bernstrom | 418/61.3 |
| 5,211,551 | 5/1993 | Uppal et al. | 418/61.3 |
| 5,516,268 | 5/1996 | Kassen et al. | 418/61.3 |

*Primary Examiner*—John J. Vrablik
*Attorney, Agent, or Firm*—L. J. Kasper

[57] ABSTRACT

A fluid pressure operated device including a gerotor (17) including an orbiting and rotating star (27). A balancing plate (19) is biased into engagement by means of pressurized fluid in a space (102), with an adjacent end surface (28) of the star (27). Adjacent the balancing plate (19) is a housing member (21) defining a seal chamber (83), in which is disposed a seal assembly (89), including a support member (91) and a seal member (93) disposed radially inward from the support member. The outer periphery (92) of the support member (91) is disposed radially outward of a tangent circle (TC) of the bolts (11), thereby moving the pivot point (PP) of the balancing plate (19) further outward radially. This results in an improved ability of the balancing plate to follow the end surface of the gerotor star, whether the height of the star is more or less than that of the gerotor ring (23). As a result, volumetric efficiency is improved, even while the manufacturing cost of the gerotor gear set (17) may be reduced.

11 Claims, 5 Drawing Sheets

GEROTOR MOTOR AND IMPROVED BALANCING PLATE SEAL THEREFOR

BACKGROUND OF THE DISCLOSURE

The present invention relates to rotary fluid pressure devices, and more particularly, to such devices which include gerotor displacement mechanisms.

Although the present invention may be used advantageously with gerotor devices which are to be used as fluid pumps, the invention is especially advantageous when utilized as part of a gerotor motor, and will be described in connection therewith.

Furthermore, although the present invention may be used advantageously with gerotor motors having various types of valving, it is especially advantageous when utilized in a high pressure motor of the "valve-in-star" (VIS) type, and will be described in connection therewith. An example of a VIS motor is illustrated and described in U.S. Pat. No. 4,741,681, assigned to the assignee of the present invention and incorporated herein by reference. In a VIS motor, commutating valving action is accomplished at an interface between an orbiting and rotating gerotor star, and an adjacent, stationary valve plate, which is typically part of the motor housing.

More specifically, the present invention relates to a gerotor motor of the "wet-bolt" type, an example of which is illustrated and described in U.S. Pat. No. 5,211,551, also assigned to the assignee of the present invention and incorporated herein by reference. In a welt bolt motor, there are seals disposed between the various sections of the motor, and the fasteners (typically, bolts) which hold the sections of the motor in tight sealing engagement are disposed radially inwardly from the seals. Therefore, such a motor is referred to as a wet-bolt motor because leakage fluid flowing between adjacent sections of the motor can enter the bolt bores, then flow axially along the bore to a case drain region, etc. The use of a "wet-bolt" design in a gerotor motor is a way to reduce the size and weight, and therefore, the cost of the motor and is generally a desirable approach.

The VIS motors illustrated and described in the above-incorporated patents are high pressure, high performance motors, and it has been determined that performance characteristics such as the volumetric efficiency are improved by the use of a balancing plate, disposed adjacent the "forward" end of the gerotor, i.e., opposite the end of the gerotor where the commutating valving action occurs.

As is well known to those skilled in the art, a major cause for the loss of volumetric efficiency is difference between the "height" (i.e., axial length) of the gerotor ring and star, this difference being referred to as the "side clearance". It has been typical practice to make the star somewhat shorter than the ring, primarily to accommodate possible growth of the star caused by thermal shock (i.e., the sudden introduction of hot oil into a cold motor).

Unfortunately, the attempts by those working in the art to maintain a very small "side clearance" tolerance band, of the star relative to the ring, have always added substantially to the total manufacturing cost of gerotors of the type which are used in low speed, high torque (LSHT) motors, and especially those which are intended for high pressure and high performance.

SUMMARY OF THE INVENTION

Accordingly, it is an object of the present invention to provide an improved balancing plate and seal arrangement which makes it possible to reduce the gerotor side clearance, for increased volumetric efficiency, while at the same time increasing the side clearance tolerance band, thus reducing the manufacturing cost of the gerotor.

It is a more specific object of the present invention to provide an improved balancing plate and seal arrangement which achieves the above-stated objects at least in part by moving the "pivot point" of the balancing plate further outward radially than was known in the prior art, thus improving the ability of the balancing plate to "follow" or conform to the adjacent end surface of the gerotor star.

The above and other objects of the invention are accomplished by the provision of a fluid pressure operated device comprising housing means defining a fluid inlet port and a fluid outlet port. A fluid pressure displacement mechanism is associated with the housing means and includes an internally toothed ring member and an externally toothed star member eccentrically disposed within the ring member. The ring member and the star member have relative orbital and rotational movement and inter-engage to define expanding and contracting fluid volume chambers in response to the orbital and rotational movement. A valve means cooperates with the housing means to provide fluid communication between the inlet port and the expanding volume chambers and between the contracting volume chambers and the outlet port. The housing means comprises an end cap member disposed rearwardly of the ring member and a housing member disposed forwardly of the ring member. Seal means is disposed between the ring member and the end cap member and between the ring member and the housing member, and a plurality of fasteners are disposed in fastener bores, the fasteners maintaining the end cap member and the housing member in tight, sealing engagement relative to the ring member, the fasteners being disposed radially inward from the seal means. A balancing plate is disposed between the ring member and the housing member and is adapted to be closely disposed to an adjacent end surface of the star member, to minimize fluid leakage therebetween.

The improved fluid pressure operated device is characterized by one of the housing member and the balancing plate defining a seal chamber in open communication with the fastener bores. A seal assembly is disposed in the seal chamber, the seal assembly including a seal support member conforming substantially to an outer peripheral surface of the seal chamber and to the plurality of fasteners. The seal assembly further includes a seal member disposed radially inward from the seal support member, and restrained in the radially outward direction thereby when the seal member is subjected to fluid pressure.

In accordance with a more specific aspect of the present invention, the plurality of fastener bores defines a tangent circle contacting each fastener bore at its radially innermost point, the outer peripheral surface of the seal chamber defining a cylinder, the cylinder having a diameter greater than the diameter of the tangent circle.

DESCRIPTION OF THE PREFERRED EMBODIMENT

Figure 1:
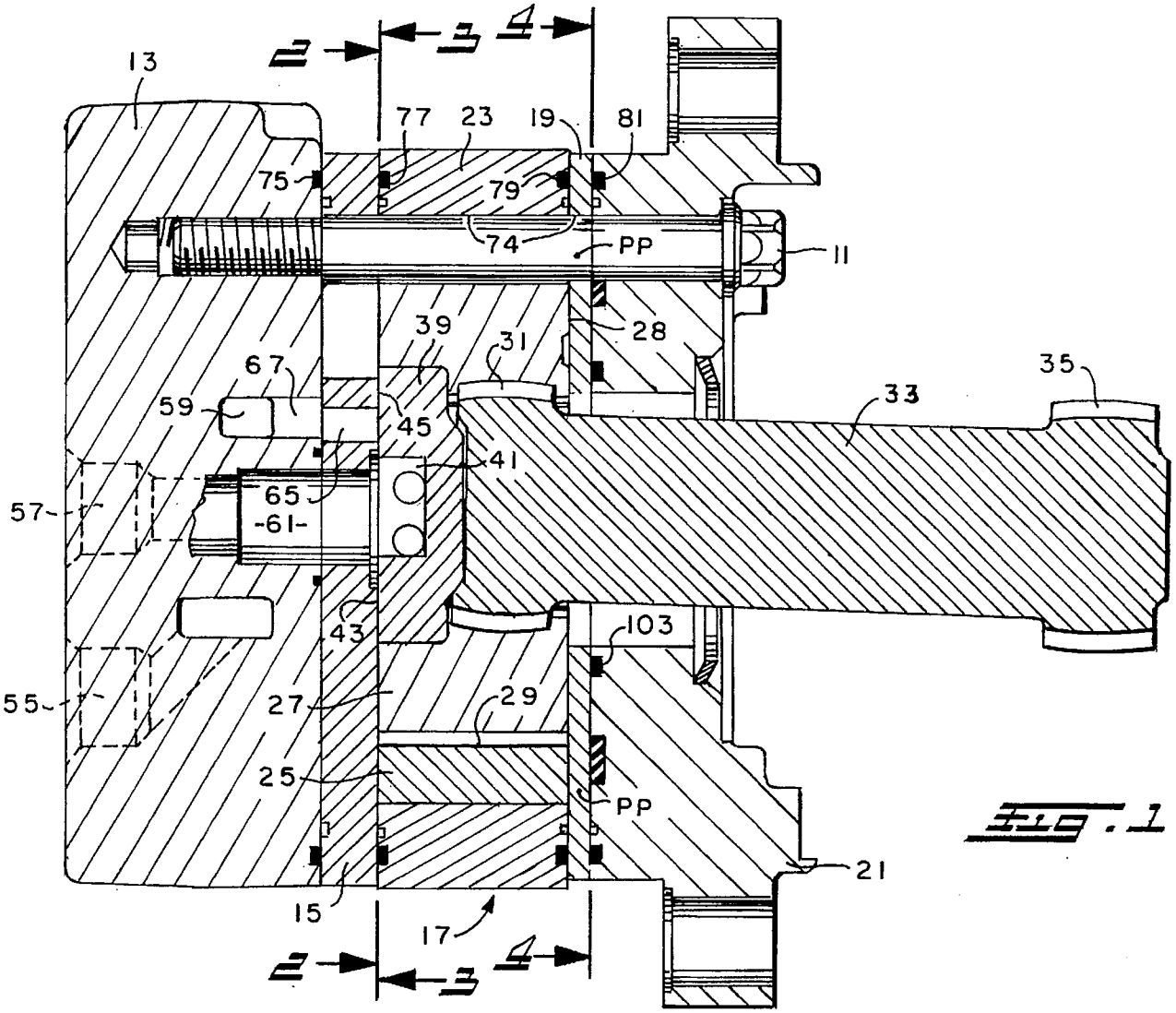
FIG. 1 is an axial cross-section illustrating a low speed, high torque VIS gerotor motor made in accordance with the present invention.

Referring now to the drawings, which are not intended to limit the invention, FIG. 1 illustrates a VIS motor made in accordance with the above-incorporated patents. More specifically, the VIS motor shown in FIG. 1 is, by way of example only, of a "wet-bolt" design, made in accordance with the teachings of above-incorporated U.S. Pat. No. 5,211,551.

Figure 3:
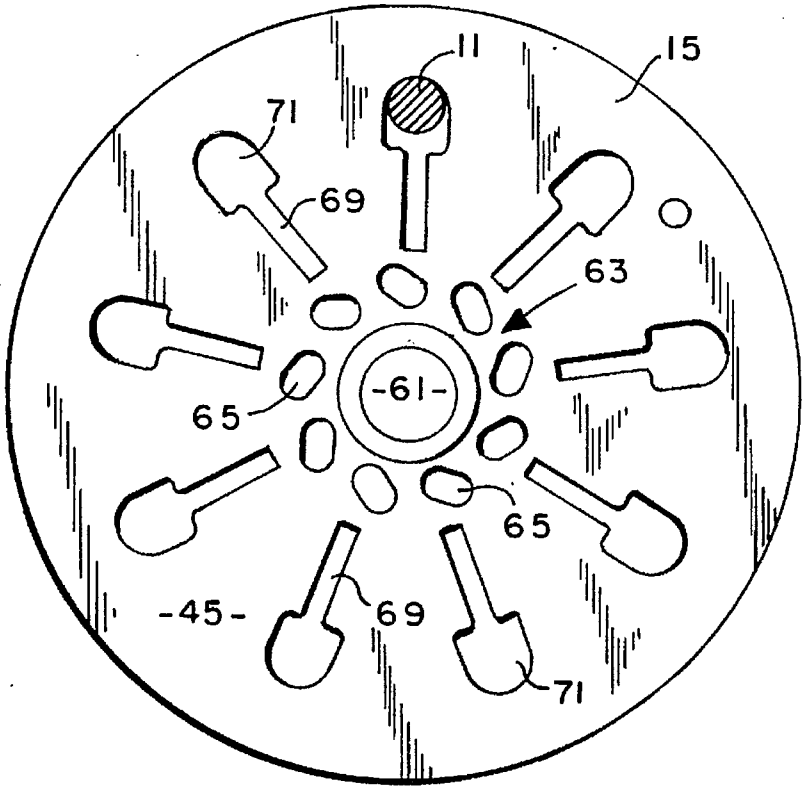
FIG. 3 is a transverse cross-section taken on line 3—3 of FIG. 1, and on a scale smaller than that of FIGS. 1 and 2.
Figure 5:
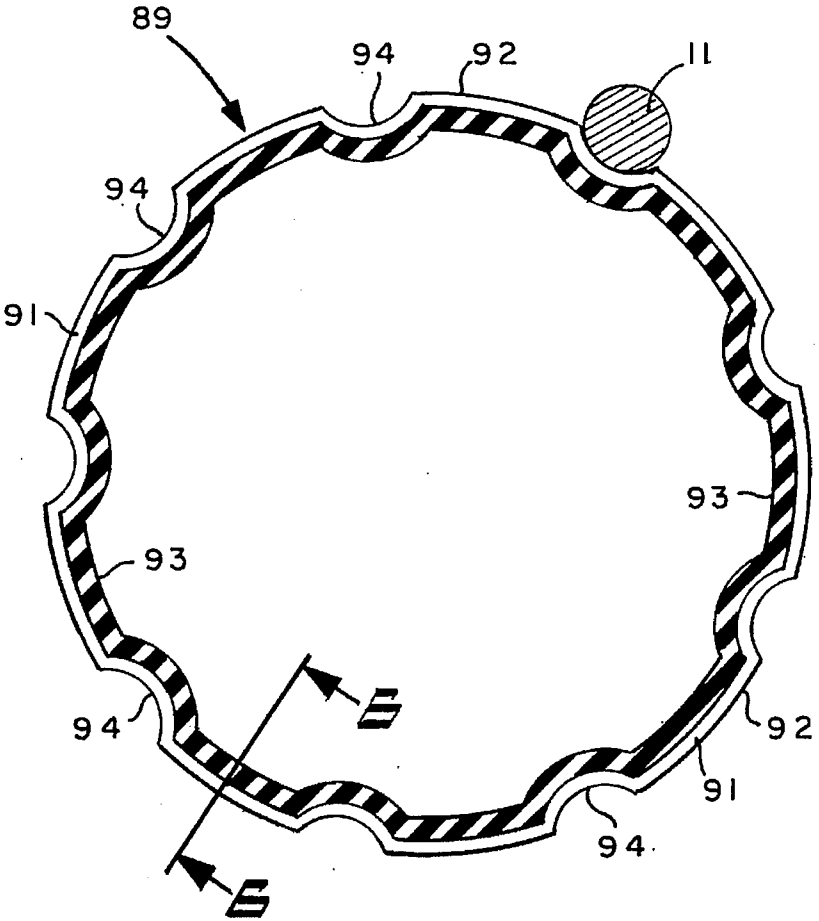
FIG. 5 is a plan view of the seal assembly of the present invention, but on a larger scale than FIG. 4.

The VIS motor shown in FIG. 1 comprises a plurality of sections secured together such as by a plurality of bolts 11, only one of which is shown in each of FIGS. 1, 3 and 5. The motor includes an end cap 13, a stationary valve plate 15, a gerotor gear set, generally designated 17, a balancing plate 19, and a flange member 21.

The gerotor gear set 17 is well known in the art, is shown and described in greater detail in the above-incorporated patents, and therefore will be described only briefly herein. The gear set 17 is preferably a Geroler® gear set comprising an internally toothed ring member 23 defining a plurality of generally semi-cylindrical openings, with a cylindrical roller member 25 disposed in each of the openings, and serving as the internal teeth of the ring member 23. Eccentrically disposed within the ring member 23 is an externally-toothed star member 27, typically having one less external tooth than the number of internal teeth 25, thus permitting the star member 27 to orbit and rotate relative to the ring member 23. The orbital and rotational movement of the star 27 within the ring 23 defines a plurality of expanding and contracting fluid volume chambers 29 (see also FIG. 6).

Referring still primarily to FIG. 1, the star 27 defines a plurality of straight, internal splines which are in engagement with a set of external, crowned splines 31, formed on one end of a main drive shaft 33. Disposed at the opposite end of the shaft 33 is another set of external, crowned splines 35, adapted to be in engagement with another set of straight internal splines defined by some form of rotary output member, such as a shaft or wheel hub (not shown). As is well known to those skilled in the art, gerotor motors of the general type shown herein may include an additional rotary output shaft, supported by suitable bearings.

Figure 2:
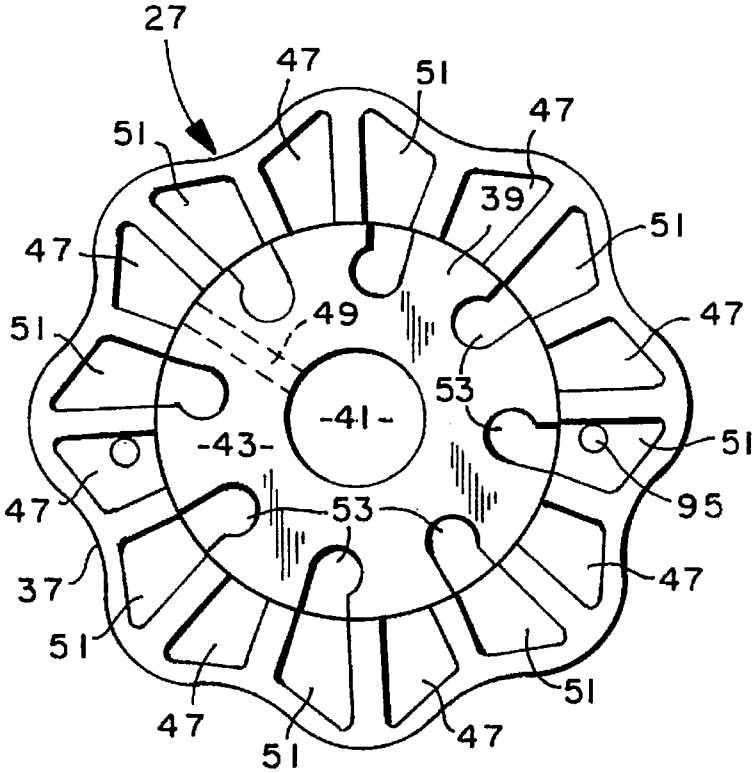
FIG. 2 is a transverse cross-section taken on line 2—2 of FIG. 1, but illustrating only the gerotor star, and on a scale slightly larger than FIG. 1.

Referring now primarily to FIG. 2, in conjunction with FIG. 1, the star member 27 will be described in greater detail. Although not an essential feature of the present invention, it is preferable that the star 27 comprise an assembly of two separate parts. In the subject embodiment, the star 27 comprises two separate parts including a main star portion 37, which includes the external teeth, and an insert or plug 39. The main portion 37 and the insert 39 cooperate to define the various fluid zones, passages, and ports which will be described subsequently.

The star member 27 defines a central manifold zone 41, defined by an end surface 43 of the star 27, the end surface 43 being disposed in sliding, sealing engagement with an adjacent surface 45 (see FIG. 3) of the stationary valve plate 15.

The end surface 43 of the star 27 defines a set of fluid ports 47, each of which is in continuous fluid communication with the manifold zone 41 by means of a fluid passage 49, defined by the insert 39 (only one of the fluid passages 49 being shown in FIG. 2). The end surface 43 further defines a set of fluid ports 51, which are arranged alternately with the fluid ports 47, each of the fluid ports 51 including a portion 53 which is defined by the insert 39 and extends radially inward, about half way, radially, to the manifold zone 41.

Referring now primarily to FIG. 3, in conjunction with FIG. 1, the end cap 13 and stationary valve plate 15 will be described in further detail. As may be seen from a review of the above-incorporated U.S. Pat. No. 5,211,551, it is known in the art to have the end cap and stationary valve plate formed as separate members, as in the subject embodiment, which then may also be referred to as an "end cap assembly". Alternatively, the end cap and stationary valve may comprise a single, integral part, in which case, reference to a "stationary valve means" or some similar terminology will be understood to refer to the portion of the end cap disposed immediately adjacent the gerotor gear set.

The end cap 13 includes a fluid inlet port 55 and a fluid outlet port 57. The end cap 13 defines an annular chamber 59 which is in open, continuous fluid communication with the inlet port 55. The end cap 13 and the stationary valve plate 15 cooperate to define a cylindrical chamber 61 which is in continuous, open fluid communication with the outlet port 57, and with the manifold zone 41, as the star 27 orbits and rotates. Surrounding the cylindrical chamber 61 is a fluid pressure region, generally designated 63, which includes a plurality of individual stationary pressure ports 65, each of which is in continuous fluid communication with the annular chamber 59 by means of a passage 67 (see FIG. 1).

The stationary valve plate 15 further defines a plurality of stationary valve passages 69, also referred to in the art as "timing slots". In the subject embodiment, each of the valve passages 69 would typically comprise a radially-oriented slot, each of which would be disposed in continuous, open fluid communication with an adjacent one of the volume chambers 29. Preferably, the valve passages 69 are disposed in a generally annular pattern which is concentric relative to the fluid pressure region 63, as is illustrated in FIG. 3. In the subject embodiment, and by way of example only, the valve passages 69 each open into an enlarged portion 71. Each of the bolts 11 passes through one of the enlarged portions 71, but as may be seen in FIG. 3, even with the bolt 11 present, fluid can still be communicated to and from the volume chambers 29 through the radially inner part of each enlarged portion 71.

Referring again primarily to FIG. 1, the plate 19 functions as a "balancing plate". System pressure (high pressure) is communicated to the forward side (i.e., the side adjacent the flange member 21) of the plate 19, in accordance with the teachings of U.S. Pat. No. 4,976,594, assigned to the assignee of the present invention, and incorporated herein by reference. For either direction of operation, the radially inward portion of the plate 19 is biased toward the star member 27. In other words, throughout one entire orbit of the star member 27, there is a net force biasing the plate 19 toward the star. However, for various reasons such as a slight tipping or cocking of the star, there may be localized areas in which there is a slight separation of the balancing plate 19 from the star 27.

During operation, high pressure fluid is communicated to the inlet port 55, and from there flows to the annular chamber 59, then through the individual passages 67 and into the pressure ports 65. As the star 27 orbits and rotates, the nine pressure ports 65 engage in commutating fluid communication with the eight radially inward portions 53 of the fluid ports 51 defined by the star 27. Thus, high pressure fluid is being communicated only to those fluid ports 51 which are in fluid communication with one of the valve passages 69, or are about to have such communication or have just completed such communication.

High pressure fluid is communicated only to those fluid ports 51 which are on the same side of the line of eccentricity as the expanding volume chambers, so that high pressure fluid then flows from those particular fluid ports 51 through the respective stationary valve passages 69, and enlarged portions 71, into the expanding volume chambers 29.

Low pressure exhaust fluid flowing out of the contracting volume chambers 29 is communicated through the respective enlarged portions 71 and valve passages 69 into the fluid ports 47 defined by the star member 27. This low pressure fluid is then communicated through the radial fluid passages 49 into the manifold zone 41, and from there, the low pressure fluid flows through the cylindrical chambers 61, and then to the outlet port 57. It will be understood by those skilled in the art that the overall, main flow path just described is generally well known in the art.

Figure 4:
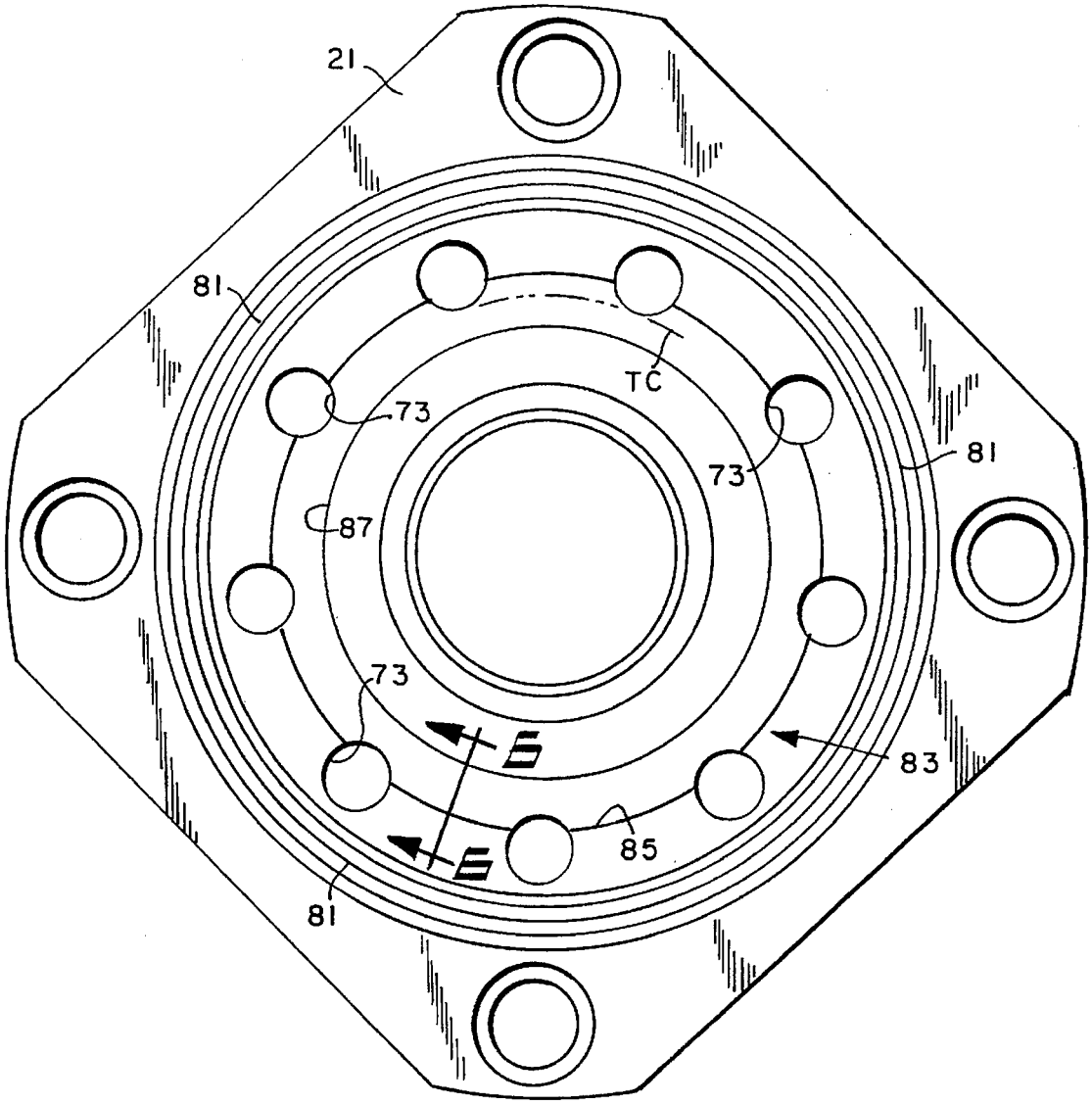
FIG. 4 is a transverse cross-section taken on line 4—4 of FIG. 1, and on the same scale, but with the bolts and the seal assembly of the present invention removed, for ease of illustration.

Referring now to FIG. 4, in conjunction with FIG. 1, the flange member 21 defines nine bolt bores 73, each of which is axially aligned with one of the enlarged portions 71, and with corresponding openings 74 (see FIG. 1) in the ring member 23 and balancing plate 19. As may best be seen in FIG. 1, the end cap 13 carries an O-ring seal 75, the opposite axial ends of the gerotor ring 23 carry O-ring seals 77 and 79, and the flange member 21 carries an O-ring seal 81 (also shown in FIG. 4).

As was described in the BACKGROUND OF THE DISCLOSURE, the present invention relates to a gerotor motor of the "wet-bolt" design, with the bolts 11 being disposed radially inward from the O-ring seals 75 through 81, rather than radially outward therefrom, as was the case in most prior art motors.

Referring now primarily to FIG. 4, the flange member 21 defines a seal chamber, generally designated 83, defining a cylindrical, radially outer periphery 85, and a cylindrical, radially inner periphery 87. It may be seen in FIG. 4 that, if one were to construct a circle tangent to the bolt bores 73 at the radially innermost point of each bore 73, the resulting tangent circle TC (shown only fragmentarily in FIG. 4) would have a diameter greater than that of the inner periphery 87, but less than that of the outer periphery 85. In other words, the seal chamber 83 is in open communication with the bolt bores 73, and the outer periphery 85 of the seal chamber 83 is disposed radially outward of the innermost point of the bores 73. Prior to the present invention, the seal chamber would have been disposed wholly radially inward from the bolts 11, such that the pivot point of the balancing plate 19 also would have been disposed further inward radially (i.e., at about the tooth tips of the gerotor star 27), such that the balancing plate 19 would have had somewhat limited capability to "follow" the adjacent end surface 28 of the star member 27.

Referring now primarily to FIG. 5, disposed in the seal chamber 83 is a seal assembly 89 comprising an outer seal support member or backup 91 and an inner seal member 93. One important aspect of the present invention is that the support member 91 is configured to have its outer periphery 92 conform substantially to the outer periphery 85 of the seal chamber 83, except where the bolts 11 and bolt bores 73 are located, in which case the support member 91 defines part-circular cut-out portions 94 each of which conforms to that portion of the bore 73 (or to the bolt 11 when the seal assembly 89 is under pressure) where it is in open communication with the seal chamber 83. This aspect of the invention is illustrated by the inclusion in FIG. 5 of one of the bolts 11, is its proper location, relative to the seal assembly 89, and it is believed that subsequent references to the seal support member 91 "conforming substantially" to the surface 85 and to the fasteners 11 should be clearly understood in view of FIG. 5. Preferably, and for ease of assembly, the outside diameter of the support member 91 should have a "slip fit" relationship to the outer periphery 85 of the seal chamber 83. However, the relationship between the inner periphery of the seal member 93 and the inner periphery 87 of the seal chamber 83 is not especially significant.

It will be understood by those skilled in the art that the primary function of the support member 91 is to make it possible for the outer periphery 85 of the seal chamber 83 to be as large as possible, while at the same time preventing extrusion of the seal member 93 into the bolt bores 73, whenever the seal 93 is under pressure. Such extrusion of the seal into the clearance between the bores 73 and the bolts 11 would quickly destroy the seal member 93. Accordingly, the support member 91 is preferably made from a fairly rigid material such as a glass-filled nylon, or some other suitable material having similar properties. The seal member 93 may be a standard elastomer seal such as a Buna N rubber, having a durometer of approximately 90 on the Shore A scale. In the subject embodiment, the support member 91 and seal member 93 have not been formed as an integral assembly, although in some applications, such an arrangement may be desirable.

In the subject embodiment, and by way of example only, the seal chamber 83 has a "depth" (axial dimension) in the range of 0.125 inches to 0.130 inches. Still by way of example only, the seal support member 91 is dimensioned so that, upon assembly, it will be subjected to a minimum squeeze of 0.001 inches, while the seal member 93 is dimensioned such that, upon assembly, it will be subjected to a minimum squeeze of 0.007 inches. Both of the squeeze amounts discussed are conventional, and well known in the art for the components and materials described.

Figure 6:
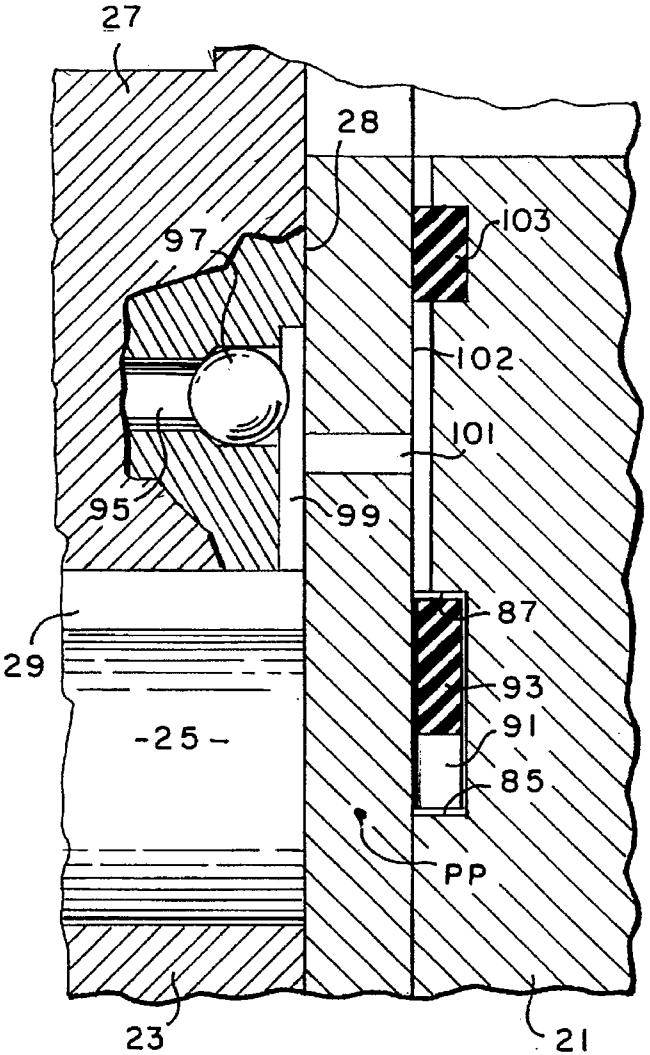
FIG. 6 is a greatly enlarged fragmentary axial cross-section, taken on line 6—6 of FIGS. 4 and 5.

Referring now primarily to FIG. 6, it may be seen that the star member 27 defines an axial passage 95, at the forward end of which is seated a check ball 97, which permits the passage of pressurized fluid from one of the star ports 51 to a pressure balancing recess 99 formed in the forward end surface 28 of the star 27, in accordance with the teachings of above-incorporated U.S. Pat. No. 4,976,594. The balancing plate 19 defines a passage 101 which communicates pressurizes fluid from the recess 99 to a space 102, disposed between the balancing plate 19 and the adjacent surface of the flange member 21. In the subject embodiment, and by way of example only, there are four of the passages 101, and the axial dimension of the space 102 is about 0.009 inches. The space 102 is bounded on the outside, radially, by the seal assembly 89, and is bounded on the inside, radially, by an O-ring seal assembly 103, which would typically include a backup or support member and a seal member, preferably made from the same materials as the support member 91 and seal 93, respectively, but having a conventional annular configuration. As a result, there normally exists a net hydraulic force acting on the balancing plate 19, tending to bias the balancing plate to the left in FIG. 1, toward the adjacent end surface 28 of the star 27.

As was mentioned previously, without the present invention, the pivot point of the balancing plate would be located at approximately the outer tooth tips of the star member 27, i.e., at approximately the radius of the inner periphery 87. Those skilled in the art will understand that the "pivot point" of the balancing plate is a point (or more accurately, a circle) separating the radially outer portion of the plate, which is constrained to remain perfectly perpendicular to the axis, from the radially inner portion of the plate, which is able to deflect and "follow" the adjacent end surface 28 of the star 27.

It is one important aspect of the present invention that the seal assembly 89 is moved radially outward, thus substantially increasing the portion of the balancing plate 19 which is able to move axially. By way of example only, the seal assembly 89 of the present invention results in the balancing plate 19 having a pivot point PP which approximately coincides, radially, with the outer periphery 85 of the seal chamber 83 (see FIGS. 1 and 6).

As a result of the present invention, and the increased ability of the balancing plate 19 to follow the end surface 28 of the star 27, and conform thereto, the axial height of the star 27 can be very nearly equal to the axial height of the ring 23 (i.e., a very small side clearance), thus increasing volumetric efficiency of the motor. At the same time, the present invention makes it possible for the balancing plate 19 to maintain good sealing engagement with the end surface 28 of the star 27 even in the event of a thermal shock which causes the height of the star to exceed, temporarily, the height of the ring. In other words, by moving the pivot point PP of the balancing plate 19 further outward radially, the present invention makes it possible for the balancing plate to pivot or move in either direction, to accommodate the star being either shorter or longer than the ring. Therefore, the tolerance band on the side clearance can be substantially increased, thus reducing precision machining and finishing of the ring and star, and making the overall manufacturing cost of the gerotor much less than in the past.

Figure 7:
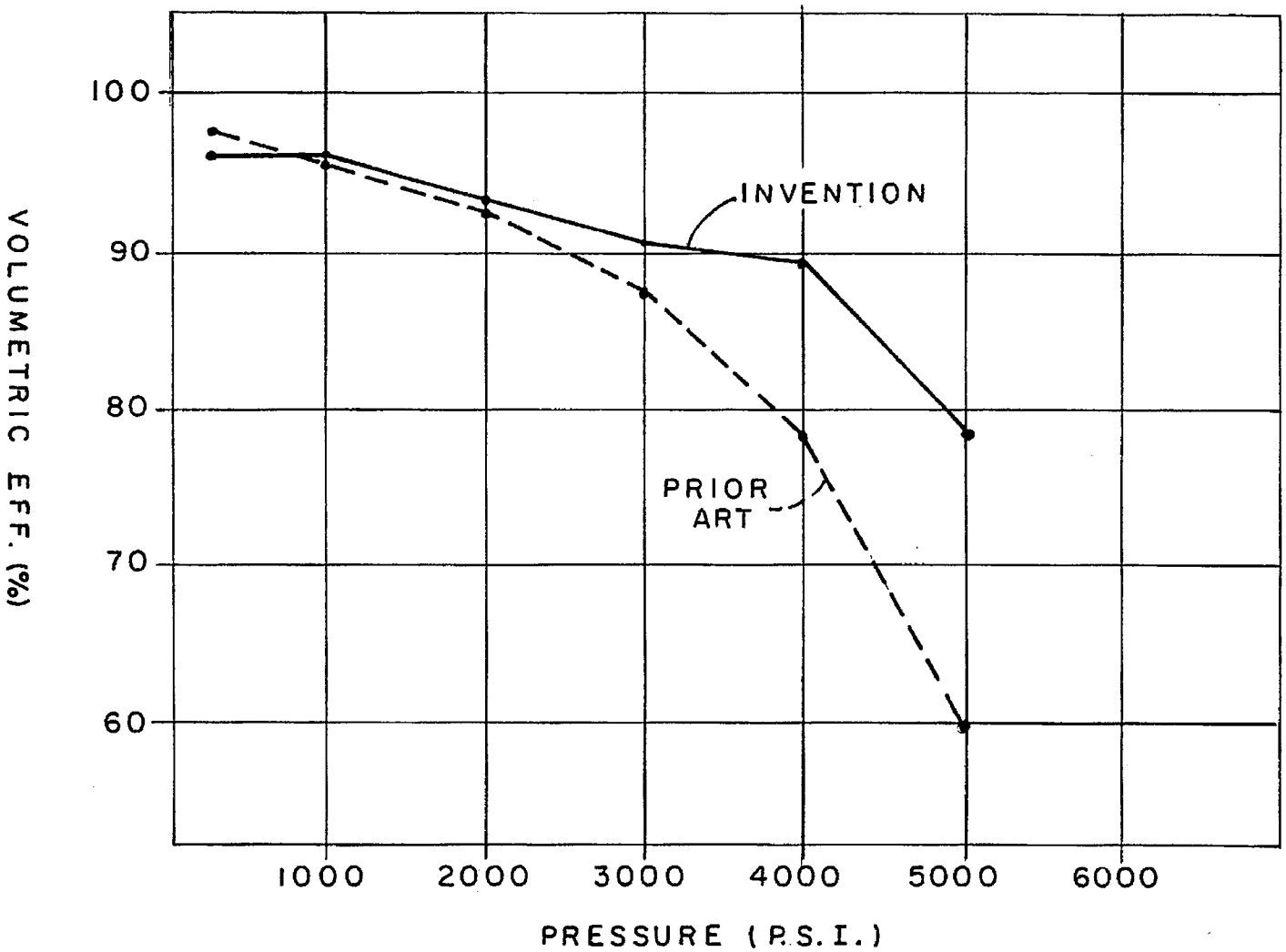
FIG. 7 is a graph of volumetric efficiency (as a percentage), versus pressure (in PSI), comparing the "INVENTION" with the "PRIOR ART".

Referring now primarily to FIG. 7, there is a comparison of the INVENTION with the PRIOR ART motor. Both sets of data in FIG. 7 were generated on the same motor model or design, and running under the same operating conditions, except that the curve labeled "INVENTION" was generated by a motor including the seal assembly 89. In the "PRIOR ART" motor, there was merely a conventional O-ring seal adjacent the balancing plate 19, and in generally the same location as the seal assembly 89. In addition, the motor of the "INVENTION" had a reduced side clearance, but because of the presence of the invention, the motor was still able to pass the thermal shock test.

The motor used to generate the data represented in FIG. 7 was a motor now being sold commercially by the assignee of the present invention as a VIS 45 motor, having a 34.9 cubic inch displacement gerotor gear set, with the oil temperature at the inlet to the motor being maintained at 140° Fahrenheit. In performing the testing on the motor, for both the PRIOR ART and the INVENTION, the flow of fluid to the motor was maintained at 10 gpm throughout the test, and appropriate readings were taken, and volumetric efficiencies calculated, at the following pressure differentials: 250, 1000, 2000, 3000, 4000 and 5000 psi. As is clearly shown in FIG. 7, at lower pressure differentials, the PRIOR ART motor had a volumetric efficiency nearly as good as that of the INVENTION. However, at 3000 psi, the motor of the INVENTION was about 3% better than the PRIOR ART, while at 4000 psi, the improvement was slightly more than 10%, and finally, at 5000 psi, the INVENTION was 19% better than the PRIOR ART.

Thus, it may be seen that the present invention makes it possible to provide a gerotor motor which can operate at elevated pressures, while still maintaining volumetric efficiencies which are reasonably good, and which are substantially better than would be possible without the invention. A the same time, the invention makes it possible to use a less expensive gerotor gear set, having a larger tolerance on the side clearance.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A fluid pressure operated device comprising housing means defining a fluid inlet port and a fluid outlet port; a fluid pressure displacement mechanism is associated with said housing means and including an internally-toothed ring member and an externally-toothed star member eccentrically disposed within said ring member; said ring member and said star member having relative orbital and rotational movement, and inter-engaging to define expanding and contracting fluid volume chambers in response to said orbital and rotational movement; valve means cooperating with said housing means to provide fluid communication between said fluid inlet port and said expanding volume chambers, and between said contracting volume chambers and said fluid outlet port; said housing means comprising an end cap member disposed rearwardly of said ring member and a housing member disposed forwardly of said ring member; seal means disposed between said ring member and said endcap member and seal means disposed between said ring member and said housing member, and a plurality of fasteners disposed in fastener bores, said fasteners maintaining said end cap member and said housing member in tight, sealing engagement relative to said ring member, said fasteners being disposed radially inward from said seal means; a balancing plate disposed between said ring member and said housing member and adapted to be closely disposed to an adjacent end surface of said star member, to minimize fluid leakage therebetween; characterized by:

(a) one of said housing member and said balancing plate defining a seal chamber in open communication with said fastener bores;

(b) a seal assembly disposed in said seal chamber, said seal assembly including a seal support member conforming substantially to an outer peripheral surface of said seal chamber and to said plurality of fasteners; and (c) said seal assembly further including a seal member disposed radially inward from said seal support member, and restrained in the radially outward direction thereby when said seal member is subjected to fluid pressure.

2. A fluid pressure operated device as claimed in claim 1, characterized by said plurality of fastener bores defining a tangent circle contacting each fastener bore at its radially innermost point, said outer peripheral surface of said seal chamber defining a cylinder, said cylinder having a diameter greater than the diameter of said tangent circle.

3. A fluid pressure operated device as claimed in claim 2, characterized by said seal support member having an outer periphery which is generally circular, but with part-circular cut-out portions to accommodate said fasteners.

4. A fluid pressure operated device as claimed in claim 1, characterized by said fluid pressure displacement mechanism comprising a stationary ring member and an orbiting and rotating star member; each of said plurality of fasteners extends through an opening defined by said ring member; each of said openings being in direct, open fluid communication with one of said fluid volume chambers.

5. A fluid pressure operated device as claimed in claim 4, characterized by said internally-toothed ring member defining a plurality of generally semi-cylindrical openings, and a cylindrical roller member disposed in each of said openings; said roller members comprising the internal teeth of said internally-toothed member.

6. A fluid pressure operated device as claimed in claim 1, characterized by said valve means being disposed rearwardly of said internally-toothed ring member, and said end cap member defining said fluid inlet port and said fluid outlet port.

7. A fluid pressure operated device as claimed in claim 6, characterized by said housing means comprises a stationary valve member disposed axially between said end cap member and said fluid pressure displacement mechanism, said stationary valve member defining a plurality of stationary valve passages, one of said stationary valve passages being in continuous fluid communication with each of said expanding and contracting fluid volume chambers.

8. A fluid pressure operated device as claimed in claim 7, characterized by said externally-toothed star member defining a first set of fluid ports in communication with said fluid inlet port, and a second set of fluid ports in communication with said fluid outlet port, said first and second sets of fluid ports being in commutating fluid communication with said stationary valve passages.

9. A fluid pressure operated device as claimed in claim 2, characterized by said balancing plate comprising a relatively thin, flat plate member, and said housing member defining said seal chamber.

10. A fluid pressure operated device as claimed in claim 9, characterized by said balancing plate defining a pivot point, said pivot point being disposed radially outward of said tangent circle.

11. A fluid pressure operated device as claimed in claim 10, characterized by said pivot point of said balancing plate being disposed axially adjacent said outer peripheral surface of said seal chamber, thereby increasing the surface-to-surface engagement of said balancing plate and said adjacent end surface of said star member.

* * * * *